US009700751B2

(12) United States Patent
Verdi

(10) Patent No.: US 9,700,751 B2
(45) Date of Patent: Jul. 11, 2017

(54) APPARATUS AND METHOD FOR MUSCLE MOVEMENT TRAINING

(71) Applicant: Core Restore LLC, Allenhurst, NJ (US)

(72) Inventor: Christopher Verdi, Asbury Park, NJ (US)

(73) Assignee: Core Restore LLC, Allenhurst, NJ (US)

( * ) Notice: Subject to any disclaimer, the term of this patent is extended or adjusted under 35 U.S.C. 154(b) by 0 days.

(21) Appl. No.: 15/153,192

(22) Filed: May 12, 2016

(65) Prior Publication Data

US 2016/0256725 A1 Sep. 8, 2016

Related U.S. Application Data

(63) Continuation-in-part of application No. 13/723,783, filed on Dec. 21, 2012, now Pat. No. 9,358,413.

(Continued)

(51) Int. Cl.
*A63B 26/00* (2006.01)
*A63B 21/045* (2006.01)

(Continued)

(52) U.S. Cl.
CPC ..... *A63B 21/025* (2013.01); *A63B 17/04* (2013.01); *A63B 21/0023* (2013.01); *A63B 21/00069* (2013.01); *A63B 21/0442* (2013.01); *A63B 21/153* (2013.01); *A63B 21/16* (2013.01); *A63B 21/4003* (2015.10); *A63B 21/4005* (2015.10); *A63B 21/4007* (2015.10); *A63B 21/4009* (2015.10); *A63B 21/4011* (2015.10);

(Continued)

(58) Field of Classification Search
CPC ... A63B 21/00; A63B 21/00069; A63B 21/05; A63B 21/025; A63B 21/055; A63B 21/04; A63B 21/045; A63B 21/0442; A63B 21/0455; A63B 7/00; A63B 21/00047; A63B 21/00061; A63B 21/00076; A63B 21/02; A63B 21/023; A63B 21/16
USPC ..... 482/51, 74, 78, 114, 120–124, 127, 129, 482/134, 142, 143
See application file for complete search history.

(56) References Cited

U.S. PATENT DOCUMENTS 1,432,013 A * 10/1922 Herbert ..... A63B 21/0004 482/124
1,703,375 A * 2/1929 Volk ..... A63B 69/0059 473/216

(Continued)

*Primary Examiner* — Stephen Crow
*Assistant Examiner* — Garrett Atkinson

(57) ABSTRACT

Apparatuses and methods for motion and muscle training are disclosed. An apparatus includes a first retractor device, a second retractor device and a body gear unit for engaging a human. The body gear unit is attached to the first retractor device and the second retractor device. The first retractor device and the second retractor device each provide a constant non-variable load and constant resistance in opposite directions. A method includes attaching a body gear unit to a body, attaching first and second retractor devices to the body gear unit, and performing at least one movement using the body gear unit. The at least one movement is performed in a direction that is opposite to a direction of resistance of the first retractor device. A direction of resistance of the second retractor device is opposite to the direction of resistance of the first retractor device.

18 Claims, 7 Drawing Sheets

Related U.S. Application Data

(60) Provisional application No. 61/579,457, filed on Dec. 22, 2011.

(51) Int. Cl.

| | |
|---|---|
| ***A63B 21/02*** | (2006.01) |
| ***A63B 21/04*** | (2006.01) |
| ***A63B 21/16*** | (2006.01) |
| ***A63B 21/00*** | (2006.01) |
| ***A63B 21/002*** | (2006.01) |
| ***A63B 17/04*** | (2006.01) |
| *A63B 71/06* | (2006.01) |

(52) U.S. Cl.

CPC ..... *A63B 21/4015* (2015.10); *A63B 21/4017* (2015.10); *A63B 21/4019* (2015.10); *A63B 21/045* (2013.01); *A63B 2071/065* (2013.01); *A63B 2209/02* (2013.01); *A63B 2209/10* (2013.01); *A63B 2220/51* (2013.01)

(56) References Cited

U.S. PATENT DOCUMENTS 1,734,238 A * 11/1929 Sweeney ..... A63B 21/0004 482/123
1,867,642 A * 7/1932 Woods ..... A63B 21/04 482/125
2,959,414 A * 11/1960 Saltz ..... A63B 21/04 242/379.2
3,083,037 A * 3/1963 Gordon ..... A63B 19/04 280/206
3,701,529 A * 10/1972 Kruthaupt ..... A63B 5/00 482/123
3,804,420 A * 4/1974 Boyd ..... A63B 69/0059 273/DIG. 21
3,995,853 A * 12/1976 Deluty ..... A63B 21/015 482/116
4,135,714 A * 1/1979 Hughes ..... A63B 21/04 473/229
4,174,832 A * 11/1979 Thompson ..... A63B 21/018 482/120
4,195,834 A * 4/1980 Lambert, Jr. ..... A63B 21/06 482/101
4,328,965 A * 5/1982 Hatfield ..... A63B 21/025 124/23.1
4,944,511 A * 7/1990 Francis ..... A63B 21/02 482/116
4,961,573 A * 10/1990 Wehrell ..... A63B 21/0552 482/124
5,090,694 A * 2/1992 Pauls ..... A63B 21/015 482/118
5,147,265 A * 9/1992 Pauls ..... A63B 21/015 482/115
5,158,510 A * 10/1992 Lemire ..... A63B 21/4001 482/51
5,358,461 A * 10/1994 Bailey, Jr. ..... A63B 21/0053 290/1 R
5,382,212 A * 1/1995 Davenport ..... A63B 21/04 482/121
D359,324 S * 6/1995 Phegley ..... D21/662
5,486,149 A * 1/1996 Smith ..... A63B 21/015 482/120
5,509,873 A * 4/1996 Corn ..... A63B 21/153 482/124
5,618,249 A * 4/1997 Marshall ..... A63B 21/153 482/115
5,669,858 A * 9/1997 Blair ..... A63B 5/11 280/204
D399,272 S * 10/1998 Zwonitzer ..... D21/683
6,099,447 A * 8/2000 Ramsaroop ..... A63B 21/153 482/107
6,120,422 A * 9/2000 Kiemer ..... A63B 21/015 482/114
6,224,514 B1 * 5/2001 Price ..... A63B 21/055 242/470
6,436,006 B1 * 8/2002 Zemlyakov ..... A63B 21/0083 482/112
D487,123 S * 2/2004 Ihli ..... D21/662
7,338,418 B2 * 3/2008 Erez ..... A63B 69/0059 119/770
7,462,141 B1 * 12/2008 Raboin ..... A63B 21/225 482/110
7,637,853 B2 * 12/2009 Crowson ..... A63B 21/00 482/127
7,666,126 B2 * 2/2010 Rempe ..... A63B 22/18 482/121
7,780,587 B2 * 8/2010 Thornton ..... A61H 3/008 119/770
7,887,471 B2 * 2/2011 McSorley ..... A63B 21/0552 482/136
8,075,453 B1 * 12/2011 Wilkinson ..... A63B 21/00069 482/51
8,323,127 B2 * 12/2012 Webb ..... A63B 69/0002 473/422
8,465,401 B1 * 6/2013 Ihli ..... A63B 21/00185 482/116
8,556,785 B1 * 10/2013 Ihli ..... A63B 21/015 482/116
2006/0035770 A1 * 2/2006 Crowson ..... A63B 21/00 482/129
2007/0015641 A1 * 1/2007 Demeniuk ..... A63B 21/0004 482/124
2010/0130338 A1 * 5/2010 Wehrell ..... A61H 1/0229 482/124

* cited by examiner

APPARATUS AND METHOD FOR MUSCLE MOVEMENT TRAINING

CROSS-REFERENCE TO RELATED APPLICATIONS

This application is a continuation-in-part of U.S. patent application Ser. No. 13/723,783, filed Dec. 21, 2012, which claims priority to U.S. Provisional Patent Application Ser. No. 61/579,457, filed Dec. 22, 2011. Both of these applications are herein incorporated by reference in their entireties.

FIELD OF THE DISCLOSURE

The present disclosure relates to an apparatus for training the movement of muscles.

BACKGROUND

Existing exercise equipment and methodologies focus on power, strength, endurance, stability and balance. These existing techniques and equipment typically fall under three main categories of flexibility exercises, aerobic exercises and anaerobic exercises. For example, Pilates and yoga incorporate flexibility exercises and aerobic exercises, while weight training and weight machines typically provide anaerobic exercises. However, these existing techniques reinforce an individual's limitations in asymmetrical motion by only focusing on exercises, poses, positions and/or flexibility of the individual. In addition, such existing techniques and associated equipment focus on the lengthening of muscles and concentric movement. Generally, existing techniques emphasize greater movement over less movement and seek to increase load and force on the body for muscular adaptation. However, this can reinforce an individual's dominant plane(s) of motion and consequently under address the individual's weakest plane(s) of motion. Further, when increasing weight loads in existing techniques, increments in additional load are typically large, and require large steps in progression, which can lead to over-stressing of the muscular system, risking injury.

SUMMARY

Embodiments of the present disclosure disclose an apparatus and methods for muscle movement training which provides a foundation to prevailing fitness models that focus only on power, strength, endurance, stability and balance. In one embodiment, the apparatus includes a Core Cube and at least one Mechanical Muscle. In one embodiment, the apparatus further includes Body Hook Gear for use with the at least one Mechanical Muscle and the Core Cube. In various embodiments, the apparatus provides direct lines of force for optimal muscle contraction. In particular, in one embodiment the apparatus can provide opposing lines of force in any three-dimensional orientation relative to a user. For example, the apparatus may provide constant and consistent resistance in two opposing directions (e.g., in the directions of concentric muscle contraction, the positive direction of pull, and eccentric muscle contraction, the negative direction of pull) using at least two Mechanical Muscles. In one embodiment, a constant line of force is achieved using at least one Mechanical Muscle which comprises a torsion spring that allows for a rewind of a cord without the use of friction plates, thus providing a constant load over the useable range. In one embodiment, an adjustable control knob on the Mechanical Muscle provides for easy adjustment of loads and provides for a continuum of loads within a given working range.

In one embodiment, an apparatus includes a first retractor device, a second retractor device and a body gear unit for engaging a human. The body gear unit is attached to the first retractor device and the second retractor device. The first retractor device and the second retractor device each provide a constant non-variable load and constant resistance in opposite directions. In another embodiment a method includes attaching a body gear unit to a body, attaching first and second retractor devices to the body gear unit, and performing at least one movement using the body gear unit. The at least one movement is performed in a direction that is opposite to a direction of resistance of the first retractor device. A direction of resistance of the second retractor device is opposite to the direction of resistance of the first retractor device.

BRIEF DESCRIPTION OF THE DRAWINGS

The teachings of the present disclosure can be readily understood by considering the following detailed description in conjunction with the accompanying drawings, in which.

To facilitate understanding, identical reference numerals have been used, where possible, to designate identical elements that are common to the figures.

DETAILED DESCRIPTION

Figure 1:
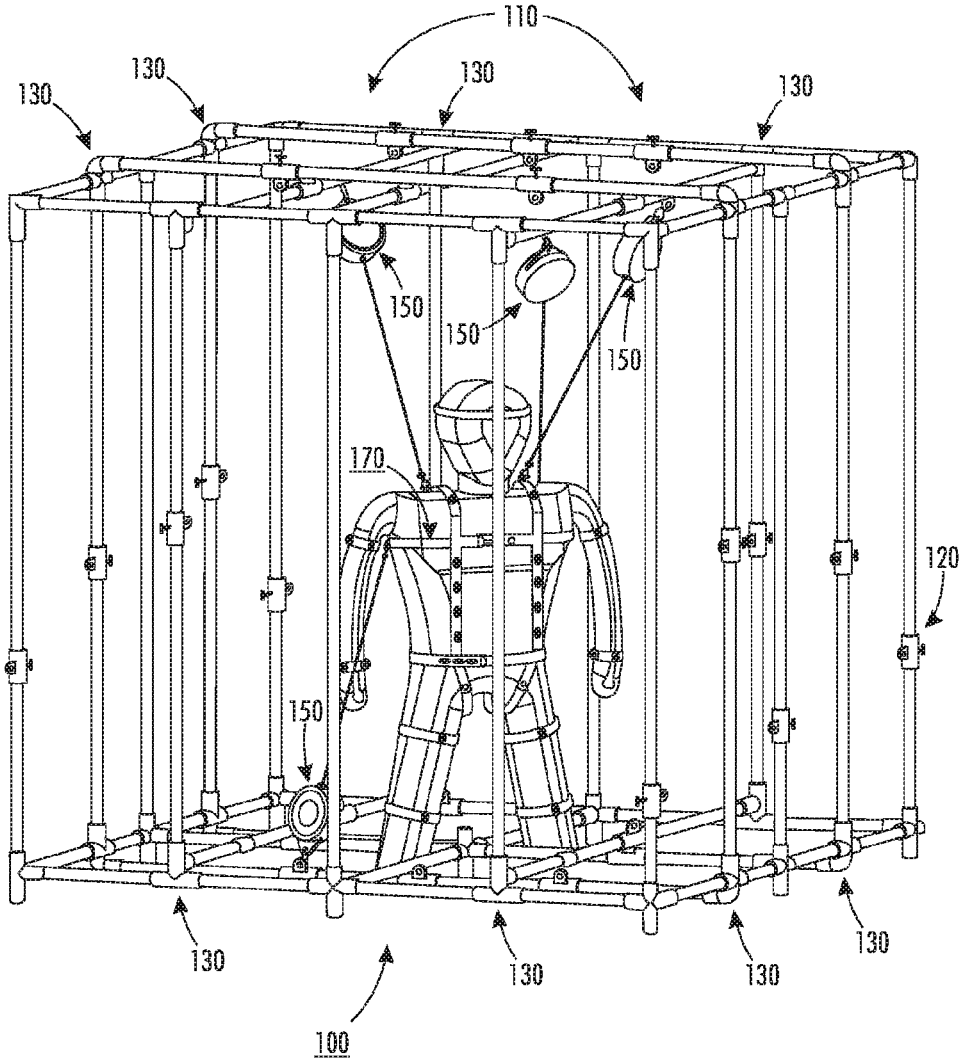
FIG. 1 is an isometric front view of an exemplary Core Restore Training System apparatus, according to one embodiment.

Embodiments of the present disclosure assist in training an individual for symmetry based on the individual's muscle imbalances and range of motion limitations. In one embodiment, a Core Restore Training System apparatus consists of three primary apparatus components: a Core Cube, at least one Mechanical Muscle™, and Body Hook Gear. These three components work in conjunction to provide micro-progression resistance in all planes of motion with targeted directions of force for optimal muscular formation. FIG. 1 illustrates an exemplary Core Restore Training System apparatus 100.

Figure 2:
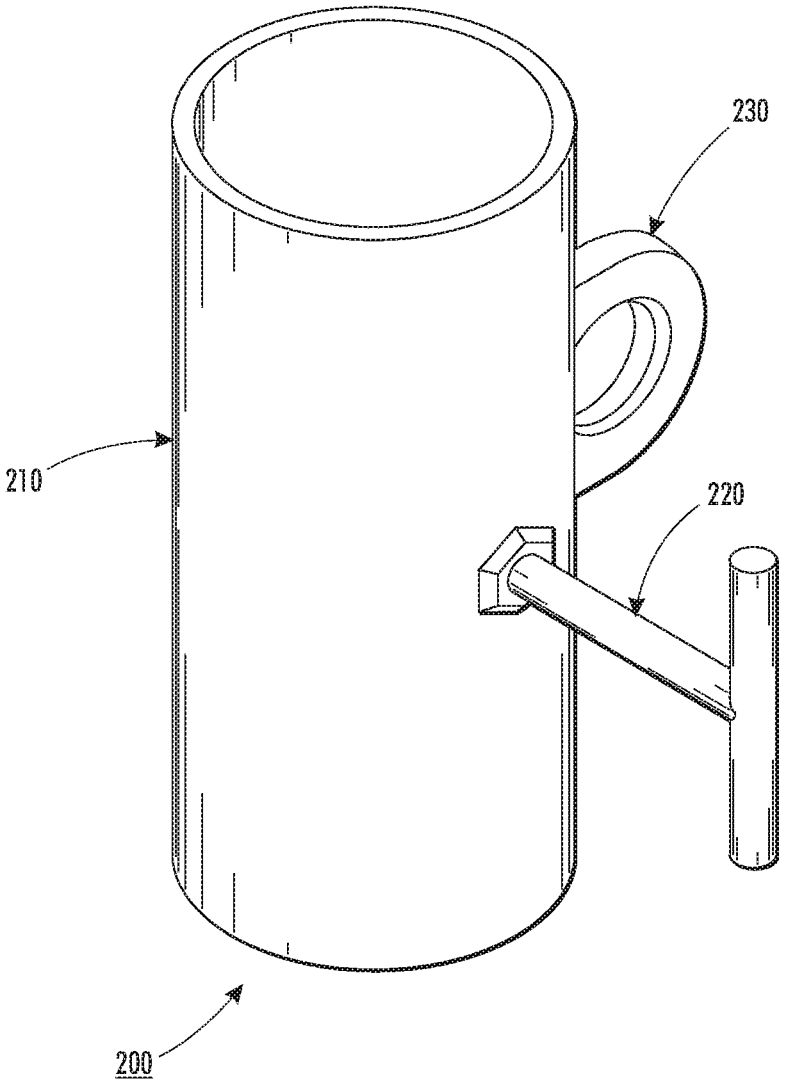
FIG. 2 is an isometric view of the adjustable anchor points of an exemplary Core Cube, according to one embodiment.

In one embodiment, the Core Cube 110 is an anchoring unit constructed of rigid materials such as steel, aluminum, plastic, fiberglass, carbon fiber, or similar ridged materials. In addition, in one embodiment an exemplary Core Cube 110 has both fixed and movable segments 130, sometimes referred to herein as intermediate members. In particular, each of the moveable segments 130 of the Core Cube 110 are movable so as to provide desired direct lines of force in desired direction(s) depending upon the particular exercise and the size and physique of the person. In further embodiments, one or more segments may be equipped with movable anchor points, e.g., anchor 120. The moveable segments 130 may be adjusted manually or with mechanical and/or electrical drives for proper positioning. The moveable segments 130 and anchors 120 ensure direct line(s) of force are maintained during use. In FIG. 1, various anchor points are shown on various movable segments that are attached to fixed horizontal and vertical segments. It should be noted that although the fixed segments are shown as cylindrical and in horizontal and vertical orientations, in other further and different embodiments, the Core Cube 110, or anchoring unit, may take the form of various other shapes which provide non-horizontal and/or non-vertical segments, and segments of various cross-sections (e.g., rectangular tubes, and various other configurations). In addition, in one embodiment an anchor point, which may be located on a movable segment, is attached to a fixed segment by means such as threaded screws, a spring loaded mechanism that engages a tab or hole in the fixed segment, and various other means. Thus, the Core Cube 110 functions as an anchoring unit for attaching, or anchoring, various Mechanical Muscles for performing various movements and exercises. For example, FIG. 2 illustrates in greater detail an exemplary anchor point 200 having a cylindrical body 210, and a threaded screw and/or spring loaded mechanism 220 for attaching the anchor point 200 to a Core Cube, e.g., to a segment of a Core Cube, and an eye 230 for attaching one or more Mechanical Muscles.

Figure 3:
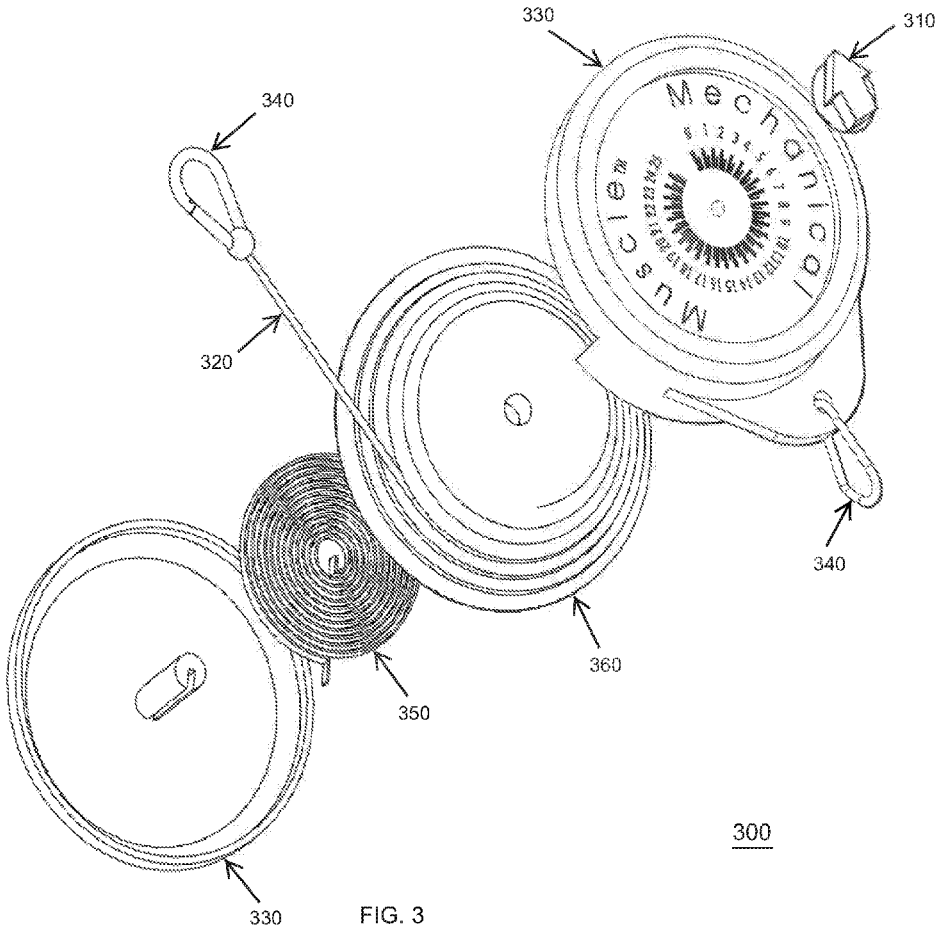
FIG. 3 is an exploded view of an exemplary Mechanical Muscle, according to one embodiment.

According to aspects of the present disclosure, a Mechanical Muscle is a device that attaches to a Core Cube at one or more of the anchor points. For example, FIG. 1 illustrates four Mechanical Muscles 150 for use in performing various exercises, as described in greater detail below. In one embodiment, each of the Mechanical Muscles 150 comprises a torsion spring retractor equipped with a tapered cam, or drum, for constant tension throughout the working length. FIG. 3 illustrates an exemplary Mechanical Muscle 300 in greater detail.

For example, as illustrated in FIG. 3, Mechanical Muscle 300 may comprise a spring-loaded device, that may be equipped with an adjusting knob 310 to easily add or remove tension in the spring 350, and that allows the user to maintain a constant non-variable load during the exercise. The adjusting knob 310 is calibrated in units (e.g., pounds, kilograms, etc.) that correspond to the tension being added to or removed from the spring 350. In some embodiments, the Mechanical Muscle 300 may indicate, for instance, ½ or 1 pound increments for assisting a user in setting an appropriate load. In various embodiments, the Mechanical Muscle 300 includes a cord 320 of natural, synthetic, or metallic materials of a predetermined length. In one embodiment, a tampered cam, or drum 360 provides a constant non-variable load over the working stroke.

In one embodiment, the Mechanical Muscle 300 comprises any one or more of the following components: a housing 330, opposing hooking devices 340, a cable 320, a load adjusting knob and/or a load indicator gauge 310, a torsion spring 350, and a tapered drum 360.

The Mechanical Muscle housing 330 can be designed in a round, square, or rectangular shape and made out of metallic or synthetic materials such as plastic or fiberglass but not limited to these materials.

The Mechanical Muscle 300 is equipped with two (2) hooks 340 that are attached in opposing directions. The hooks are positioned in such a manner that they are between 90° and 180° apart. In one embodiment, one of the hooks 340 is a swivel hook that is attached directly to the housing 330 and is also attached to the Core Cube. The other hook 340 is attached to the cable and is also for attaching to the Body Gear on the person exercising.

In one embodiment, the cable 320 is attached to the tapered drum 360 at one end and the other end is attached to one of the hooks 340. In one embodiment, the working length of the cable is between a length of 36" (0.9 m) and 72" (1.8 m), depending on the exercise. In one embodiment, the tapered drum 360 comprises a conic or a substantially conic shape. As the cable 320 extends or retracts on the drum 360, the fulcrum point where the cable 320 meets the tapered drum 360 is either increased or decreased to maintain a constant load on the cable 320.

In one embodiment, the Mechanical Muscle 300 is equipped with a load-adjusting knob 310 that increases or decreases the tension on the internal torsion spring 350. By increasing or decreasing tension on the torsion spring 350, the Mechanical Muscle 300 is set to the proper load that the exerciser needs for the exercise they are performing. Notably, while the tension in the spring 350 is variable, the tension in the cord 320 and the load experienced by the user remains constant and non-variable throughout the motion. As will be understood by those skilled in the art, the torsion spring 350 is attached to the tapered drum 360 such that as the tapered drum 360 turns in one direction, torque builds in the spring 350. However, since the drum 360 is tapered, the radius to the fulcrum point changes to provide a constant resistance over the working range of the spring 350. For instance, the cord 320 may be spirally wound around the tapered drum 360 such that the cord 320 extends and retracts as the drum 360 turns. In one embodiment, a load indicator gauge 310 is attached to the torsion spring 350 and provides a visual display of the load on the cable 320 as the cable 320 is extending or retracting. It should be noted that although exemplary Mechanical Muscles are described herein, the present disclosure is not so limited. Namely, in other, further and different embodiments any one or more Mechanical Muscles may comprise a different type of retractor device that is capable of providing a constant and consistent resistance and non-variable load throughout a range of movement for a particular exercise or motion.

Returning to FIG. 1, an exemplary Mechanical Muscle 150 at one end is attached to the Core Cube 110 and a second end is clipped into a hook on the Body Hook Gear 170 (being worn by an individual/user). For example, the second end is attached to the interior cord that can be pulled out of the Mechanical Muscle against the internal resistance of the spring. The individual selects the load that they desire for the motion being preformed. During the exercise, the cord is extended and returned automatically under constant tension.

In one aspect of the present disclosure, the Body Hook Gear 170 is comprised of adjustable hook and loop fastener straps (e.g., Velcro™) that are worn by the user at multiple joint locations throughout the user's body. Exemplary body straps are discussed below which include Velcro™ fasteners and metallic hooks. However, it should be noted that other, further and different embodiments may employ body straps having alternative configurations, such as various fastening mechanisms including but not limited to ties, buttons, clips, belts and the like. Further, in various embodiments the hooks and straps may comprise various shapes, materials and sizes, in addition to those depicted and described in connection with the exemplary embodiments herein (e.g., plastics or carbon fiber, rectangular loops, square loops, half-rings, and the like). Exemplary Body Gear Hooks according to various embodiments are shown in FIGS. 4-7. In this regard, it should be noted that as described herein, any one or more of the components of the Body Hook Gear, or body straps, may be referred to individually or collectively as a body gear unit.

To use the Core Restore Training System apparatus 100, the user starts by standing, sitting, or lying inside the Core Cube 110 and is manually attached to various Mechanical Muscles 150 using the Body Hook Gear 170 on the user. This puts the user in control of the amount of movement his/her body needs to begin to stimulate the proper muscles. One or more Mechanical Muscles 150 are attached to the hooks on the Body Hook Gear 170 and to anchors (e.g., anchor point 120) on the Core Cube 110 to give a user constant non-variable load and consistent resistance, and a direct line of force, in both the concentric and eccentric muscles contractions through the entire range of motion of a movement. A micro-progression of non-variable load(s) (via control knobs on the Mechanical Muscles 150), combined with the direct line of force, allows the user to train all muscle fiber types for optimal muscular adaptation. More specifically, the Core Restore Training System apparatus 100 provides several distinct advantages.

Constant Non-Variable Load/Consistent Resistance: The Core Restore Training System apparatus provides constant tension, creating consistent resistance and load that will not fluctuate. The consistent resistance in both directions allows the user to control the positive direction of pull, or concentric muscle contraction, the hold, or isometric muscle contraction, and the negative direction of pull, or eccentric muscle contraction. This training system works by focusing on muscle contractions for a greater benefit in muscle recovery, muscle balance, muscle tone, muscle stability, and muscle control.

Direction of Force: The Core Restore Training System apparatus provides a targeted direction of force for more precise muscle development. Muscles adapt to the ways that force is applied that can have a positive or negative affect to the overall development and function of the muscular system. The type of demand placed on the body dictates the type of adaptation that will occur. The direction of the resistance is imperative for correct muscular adaptation.

Micro-progression of non-variable Load: The Core Restore Training System apparatus system allows the user to increase the resistance by very small adjustable increments (e.g., half-pound increments or one pound increments, or even a continuous range of resistances) for micro-progressive loading to minimize the external and internal stresses to the muscular system. The system is designed to eliminate this fluctuation of load so all muscle fibers are given adequate time to adapt to a non-variable load before progressing to the next increase in load. This gives the weaker muscle fibers much needed time to adapt to the stimulus which is a preventative step in decreasing compensation of stronger muscle fibers over weaker muscle fibers. From incorrect mechanical loading there are adverse changes to the physiological loading capacity of that tissue. If too much force is applied too quickly, this can leads to over-compensation and injury adversely affecting muscular adaptation and muscle function. The ability of muscles to handle mechanical loads is key to injury prevention and limits compensation.

These three principles allow for greater gains in muscle strength, muscle balance, muscle tone, muscle endurance, muscle recovery, and muscle stability/flexibility. In one embodiment, the Core Restore Training System apparatus trains an individual for proper movement based on the function of individual muscles, as well as groups of muscles. In one embodiment, the apparatus is used in the context of the Core Restore Training System (or the "system"). This system focuses on range of motion, instead of exercise per se. The philosophy of the system is bio-mechanics based: an individual needs to understand how and what to move in order to elicit the proper movement. This system starts with engaging muscles to move single body parts to eventually add multiple body parts in single and multi-dimensional planes of motion with infinite combinations of the amount of load and directions of force. This is based upon "The Building Block Principle." In particular, body parts need to work independently before integrating body parts so that full body movement can be truly beneficial.

Most methods focus on muscle lengthening, while the Core Restore Training System is focused on muscle contracting. Muscles are designed to pull in order to lengthen. Muscles need to contract in order to relax. When the muscle has an efficient muscle contraction, this will actually create more muscle length. According to embodiments of the present disclosure, the Core Restore Training System starts with: (1) isometric muscle contractions (or a "static hold"), followed by (2) eccentric muscle contractions and finally (3) concentric muscle contractions.

As a first step, isometric muscle contractions are used to prepare the body for movement because it is increasing the contractibility of the muscles. The isometric contraction (the static hold) reinforces the stabilizing characteristics (slow-twitch muscle fibers) of the muscles. By "retraining" the muscles this way, an individual gives the muscles time to engage and safely adapt to the position before beginning the movement; in essence, teaching the individual how to feel for muscular engagement.

The second position in the system focuses on the eccentric muscle contraction. Eccentric muscle contractions are the number one way to increase strength of muscles by training muscles to resist gravity and load. The body needs three times the muscle strength to withstand the forces of gravity. Eccentric muscle contractions teach an individual how to move out of a position by concentrating on muscles on the opposite side of the axis of motion. For example, trunk flexion is the position, but the muscles controlling the individual out of the motion are the trunk extenders, which are on the opposite side of the axis. In other words, the individual is not concentrating on the trunk flexors to move out of the position to create more muscle length or more movement, but focusing on the trunk extenders. By concentrating on the muscles on the opposite side of the axis of the motion, this creates more storage of elastic energy that will allow for the efficient transformation from eccentric to concentric movement, as well as greater gains in muscle strength, muscle tone, and muscle recovery, which decreases muscle soreness. Muscles have to contract more efficiently in order to relax or gain more muscle length. Muscles do not lengthen but pull.

By first focusing on the isometric and eccentric muscle contractions, this allows the user to prepare their body for movement into the third position, the concentric muscle contraction (or "the pull"). These first two steps prepare the individual to move into the third stage where the individual should feel increased range of motion, more efficient and fuller muscle contractions as well as less muscle tightness. The overall benefits are increased muscle strength, range of motion, and body awareness by understanding basic body mechanics and muscle function.

The system, according to the above principles, creates a foundation for movement. Symmetry is extremely important before starting an exercise program, more so than flexibility. For example, by comparing left and right knee flexion of an individual's joint range of motion at the knee joint, this determines the real "flexibility" of both joints and identifies asymmetry. The goal of the system is for muscles to have symmetrical motion at each joint, to make sure the joints are not over-stressed. "True flexibility" is only beneficial if it does not compromise the stability of the body and does not reinforce compensation that arises from imbalances. This system addresses limitations in ranges of motion to minimize redirecting the stress to other places in the body. The system prepares an individual's body for movement by giving less motion, when most methods concentrate on giving you more motion for more movement. It is important to move, but knowing how and what to move is most important to lessen injury and compensation.

Accordingly, embodiments of the present disclosure feature the Core Restore Training System apparatus 100 that is designed to give the individual targeted directions of force for more precise muscle development. The Core Restore Training System apparatus provides an exemplary environment in which aspects of the Core Restore Training System may be implemented. The direction of the resistance is imperative. If too much force is applied too quickly, this can lead to over-compensation and injury. The exemplary apparatus described herein provides low impact forces to the body and is designed to address an individual's limitations in range of motion and plane of motion. In addition, the exemplary apparatus, as described herein, allows an individual to move through a single range of motion with a single direction of force and progress to multiple ranges of motion with multiple directions of force at the pace of the individual. This teaches the user how to engage single muscles or groups of muscles to move their body parts through different ranges of motion. This ultimately enables the user to learn how to engage muscles properly. This system starts with engaging muscles to move single body parts to eventually add multiple body parts in single and multi-dimensional planes of motion with infinite combinations from the amount of load and directions of force.

The Core Restore Training System focuses on repetitive movement but the individual is in control of engaging muscles in order to move through ranges of motion. An individual learns how to gauge their own muscular threshold to lessen, injury, compensation, muscle soreness and muscle tightness. There is a time for more movement but with this system the key is to use less resistance/load, and less motion to achieve more motion in the future. Muscles need six to eight weeks to adapt to new stimulus while joints and bones need even more time to adapt to the new stimuli safely. This system is developed to teach the individual how to move their body by identifying movement through muscle contractions. It is easier and safer on the body. It is different than conventional training methods because it puts the user in control of the resistance instead of the resistance controlling the user, like with traditional training. It teaches the user how to properly engage their muscles to elicit movement safely and efficiently. With this system, the individual learns to identify: (a) the moving lever (the body segment) and non-moving lever (the body anchor) (b) where to feel the muscle contractions on a static hold (the isometric contraction) (c) how to control the muscles on the opposite of the axis of motion (eccentric muscle contraction {the negative}) (d) how to pull muscles into the correct position (concentric muscle contraction the {positive}) (e) an understanding of anatomical positions, directions, and terminology (f) movements of the body and (g) a basic understanding of biomechanics. The system allows the user to increase the resistance by very small increments for micro-progressive non-variable loading to minimize the external and internal stresses to the muscular system. The ability of the body to handle mechanical loads is the key. When the mechanical load fluctuates and is too high, too much, and too often, the body will react negatively.

Body Gear Hooks

Anterior, posterior and isometric views of an exemplary body gear and associated hooks are shown in FIGS. 4-7. Exemplary embodiments include: a head gear unit, scapula body gear units, trunk/torso harness body gear unit, trunk vertical body gear units, trunk horizontal body gear units, a pelvis body gear unit, shoulder body gear units, elbow body gear units, wrist body gear units, knee body gear units, ankle body gear units, hand body gear units, and feet body gear units. The description used for each unit is based upon its relationships to a respective anatomical units, or units. Thus, the orientation of each of the units is clear from the figures that show the usage of the body gear units on an exemplary manikin. For example, the head-gear unit is clearly depicted as being placed over the head of the manikin and the elbow gear units are clearly depicted as being placed over the elbows of the manikin.

Head—

Figure 4:
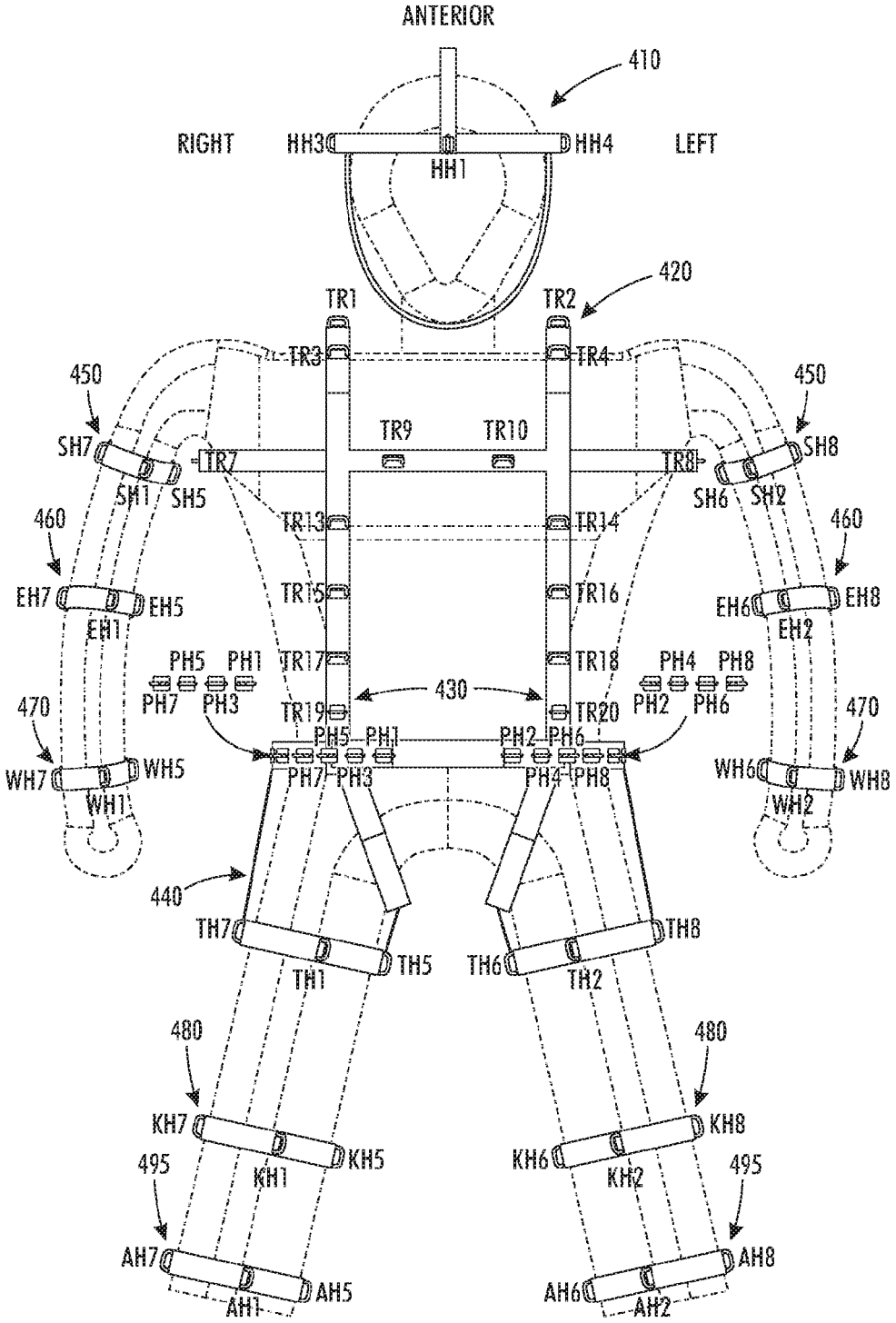
FIG. 4 illustrates a front view of an exemplary body hook gear minus two hand hook gear units and two foot hook gear units, according to one embodiment.
Figure 5:
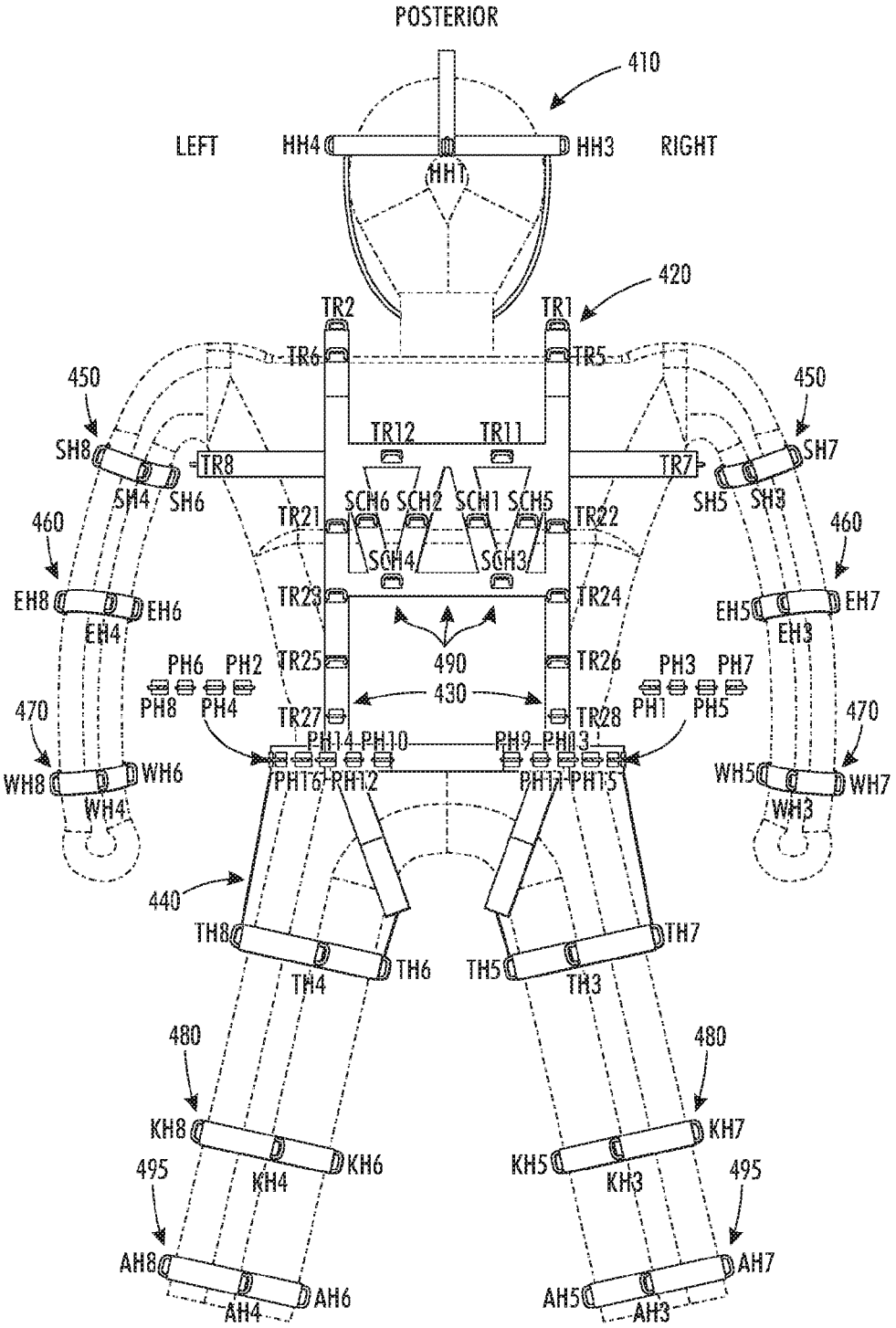
FIG. 5 illustrates a rear view of an exemplary body hook gear minus two hand hook gear units, and two foot hook gear units, according to one embodiment.

In one embodiment, as shown in FIGS. 4 and 5, a head-gear unit 410 includes four hooks. The head-gear unit 410 is placed around the forehead with hooks on the anterior HH1, posterior HH2, and hooks on the sides of the head (HH3 and HH4) with a chinstrap to hold the head strap in place. The hook on the anterior part HH1 is for cervical extension and capital extension. The hook on the posterior part HH2 is for cervical flexion and capital flexion. The hooks on the sides of the head HH3-HH4 are for cervical lateral and capital flexion as well as cervical rotation. For example, for right cervical rotation a posterior load is placed on head hook HH4 and an anterior load is placed on head hook HH3. Similar symmetrical loads are used for left cervical rotation. In addition, in some embodiments cervical extension is instead loaded anterior on head hooks HH3 and HH4. Further, in one embodiment, cervical flexion can also be loaded posterior on head hooks HH3 and HH4.

Trunk/Torso—

In one embodiment of the present disclosure, several body gear units are used in connection with the trunk/torso. For example, as shown in FIG. 5 there are two scapula body gear units 490 including scapula hooks SCH1-SCH6. These two units are removable and clip into a trunk/torso harness body gear unit 420, which is shown in FIGS. 4-5. Each of the two scapula body gear units 490 forms a triangle around the scapula for movements of protraction, retraction, and depression. Scapula movement for elevation use trunk/torso harness hooks TR11 and TR12. In one embodiment, the trunk/torso harness body gear unit 420 includes three divisions for multi-planar movements of the trunk. In one embodiment, the trunk/torso harness body gear unit 420 includes trunk hooks TR1, TR2, TR7, and TR8, which are placed on top of the shoulder and underneath the armpit for movements in the frontal plane like trunk lateral flexion. In addition, in one embodiment, the second division of the trunk/torso harness body gear unit 420 has hooks TR9, TR10, TR11, and TR12, which are placed on the front and back of the harness in-between both shoulders for sagittal plane movement of trunk flexion and extension. In one embodiment, the third division of the trunk/torso harness body gear unit 420 has hooks TR3, TR4, TR5, and TR6, which are placed below the superior trunk hooks TR1 and TR2 on the posterior and anterior sides of the harness for transverse plane movement of trunk rotation.

Embodiments of the present disclosure may also include (two) trunk vertical body gear units 430, as shown in FIGS. 4-5, that may comprise removable straps that clip underneath the trunk/torso harness body gear unit and on the top of the pelvis body gear unit for movements of trunk flexion and extension. In one embodiment, the trunk vertical body gear units 430 include anterior trunk hooks TR13 through TR20 and posterior trunk hooks TR21 through TR28. Further embodiments may also include (two) trunk horizontal body gear units (not shown) that may comprise removable straps that clip into the trunk vertical body gear units at the top and the bottom and form an "X" for movements of trunk rotation.

Pelvis—

On embodiment of the present disclosure includes a pelvis body gear unit 440, as shown in FIGS. 4-5, which may include anterior pelvis hooks PH1-PH8 and posterior pelvis hooks PH9-PH16. The pelvis body gear unit 440 wraps around/below the pelvis at the anterior/posterior superior iliac spines (ASIS and PSIS) of each leg with each leg placed into respective thigh straps. In one embodiment, the pelvis body gear unit 440 includes two thin thigh straps connected at the pelvis body gear unit to the thighs straps laterally and two thicker straps connected at pelvis body gear unit medially that have two thinner straps connected into the thigh straps medially. These straps are surrounding the legs/upper thighs so as to not restrict movement and to keep thigh straps in place with movement. The pelvis lateral hooks PLH1-PLH8 with the pelvis hooks PH1-PH16 are placed around the entire waist of the pelvis body gear unit 440 to allow for movement in all three planes of motion: anterior/posterior pelvic tilts, hip hikes (lateral flexion), and rotation. In one embodiment, the pelvis body gear unit 440 also includes thigh hooks TH1-TH8 which are placed in anterior and posterior locations on the thigh straps for hip flexion and extension as well as internal and external hip rotation. Hooks placed on the medial and lateral side of thighs are for hip abduction and adduction.

Shoulder—

Exemplary embodiments include two shoulder body gear units 450, as shown in FIGS. 4-5, that have shoulder hooks SH1-SH8. The shoulder body gear units 450 attach below the glenohumeral joint and have four hooks that attach on the medial and lateral sides of the arm and the anterior and posterior parts of the arms. These hooks are for movements of humeral flexion and extension, humeral internal and external rotation, humeral abduction and adduction, as well as humeral horizontal abduction and adduction.

Elbow—

Exemplary embodiments include two elbow body gear units 460, as shown in FIGS. 4-5, including elbow hooks EH1-EH8. The elbow body gear units 460 attach above the elbow joints and each has four hooks that attach on the medial and lateral sides of the arm and the anterior and posterior parts of the arms. These hooks are for movements of humeral flexion and extension, humeral internal and external rotation, humeral abduction and adduction as well as humeral horizontal abduction and adduction. These elbow body gear units 460 can be placed above and below the elbow joint to add or subtract motion at the elbow joint.

Wrist—

Exemplary embodiments include two wrist body gear units 470, as shown in FIGS. 4-5, having wrist hooks WH1-WH8. These body gear units attach above the wrist joints and each has four hooks that attach on the medial and lateral side of the lower arm as well as the anterior and posterior parts of the lower arm. These hooks are for movements of elbow flexion and extension and supination and pronation of the lower arm, as well as humeral flexion and extension, humeral internal and external rotation, humeral abduction and adduction and humeral horizontal abduction and adduction.

Knees—

Embodiments of the present disclosure may include two knee body gear units 480, as shown in FIGS. 4-5, having knee hooks KH1-KH8. Each of these units attaches above the knee joints and has fours hooks that attach on the medial and lateral sides of the lower thighs as well as the anterior and posterior parts of the lower thighs. These hooks are for movements of femoral internal and external rotation, femoral flexion and extension, as well as for femoral abduction and adduction. These knee body gear units can be placed above and below the knee joint to add or subtract motion at the knee joint.

Ankles—

Embodiments of the present disclosure may include two ankle body gear units, e.g., ankle body gear units 495 as shown in FIGS. 4-5, having ankle hooks AH1-AH8. These units attach above the ankle (talo-cural joint) joints and each has four hooks that are attached on the medial and lateral side of the lower leg and on the anterior and posterior parts of the lower leg. These hooks are for knee flexion and extension and tibia internal and external rotation, as well as for movements of femoral internal and external rotation, femoral flexion and extension as well as femoral abduction and adduction.

Hands—

Figure 6:
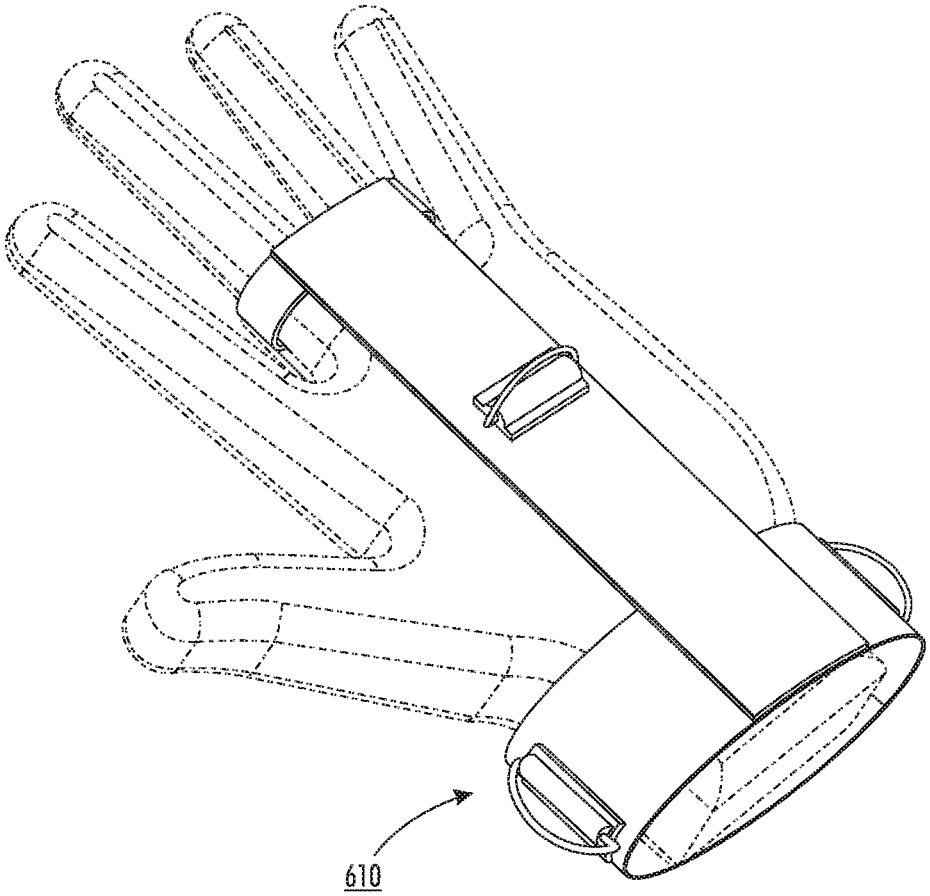
FIG. 6 is an isometric view of an exemplary hand body hook gear, according to one embodiment.

Embodiments of the present disclosure may include two hand body gear units, e.g., hand body gear unit 610 as shown in FIG. 6. For example, as shown in FIG. 6, these units attach around the second and third fingers of the hands and each has four hooks that attach on the dorsal and palmer side of the hands, as well as the medial and lateral sides of the wrists. The medial and lateral side hooks are for ulna and radial deviation. The hooks that attach on dorsal and palmer sides of the hands are for wrist flexion and extension. The dorsal and palmer hooks can be used for elbow flexion and extension as well as humeral flexion and extension and humeral abduction and adduction and humeral horizontal abduction and adduction. The hooks that attach to the medial and lateral sides of the wrist are used for supination and pronation of the lower arm as well as humeral internal and external rotation.

Feet—

Figure 7:
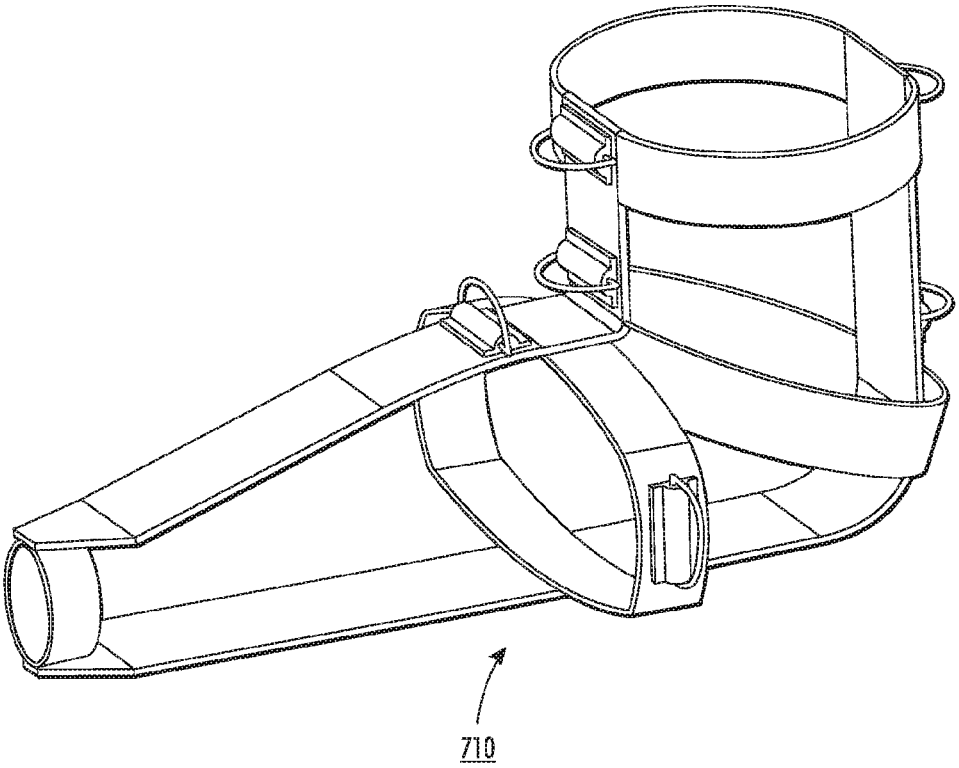
FIG. 7 is an isometric view of an exemplary foot body hook gear minus the foot of a user, according to one embodiment.

Embodiments of the present disclosure may include two feet body gear units, e.g., foot body gear unit 710 as shown in FIG. 7. For example, as shown in FIG. 7, there are eight hooks for each foot. Each foot is placed into a second toe hook/strap that connects with two thin straps into the main strap that travels along the dorsal surface and plantar surface of the foot. This main strap has three auxiliary straps with the first strap wrapping around the beginning of the mid-foot from the plantar surface of the foot and connects into dorsal surface of the foot with clips. Two feet hooks for each foot body gear unit 710 are placed at the medial and lateral sides of the mid-foot for movements of abduction and adduction of the rear-foot that combine movements of the talo-cural joint and sub-taylor joint. These foot hooks can be used for lower leg tibial internal and external rotation, as well as, femoral internal and external rotation (hip internal and external rotation). The second strap extends from the main strap that wraps underneath the sub-taylor joint and clips into the main strap at the back of the calcaneous. Another two hooks for each foot are placed on the medial and lateral sides of the rear-foot in the middle of the calcanceous for movements of eversion and inversion at the sub-taylor joint. These foot hooks can be used for femoral abduction and adduction (hip abduction and adduction). An additional two hooks per foot are placed on the main strap that attaches between the second and third auxiliary straps below the talo-cural joint for movements of dorsiflexion and plantar-flexion, as well as, knee flexion and extension and femoral flexion and extension (hip flexion and extension). The third strap extends from the main strap that wraps above the talo-cural joint and clips into the back of the tibia and fibula bones and includes a further two hooks (per each foot). These hooks are for movements of tibial internal and external rotation, knee flexion and extension, as well as, femoral internal and external rotation (hip internal and external rotation), femoral abduction and adduction (hip abduction and adduction), and femoral flexion and extension (hip flexion and extension).

Exemplary Uses of the Apparatus

Exemplary uses of the Core Restore Training System apparatus are described below. Reference may be made to FIG. 1, which illustrates a user having Body Hook Gear 170 attached to one or more Mechanical Muscles 150, which in turn are attached to a Core Cube 110 using one or more adjustable anchor points or fixed anchor points. For example, as shown in FIG. 1, the user is ready to begin combining loaded movement into right trunk rotation and right lateral trunk flexion. Reference may also be made to any one or more of FIGS. 4-7 which illustrates the location of various body gear hooks.

Right Trunk Rotation—

In FIG. 1, a user is loaded in the plane of motion which is the transverse or horizontal plane from the front and the rear to provide resistance for trunk rotation. The user moves around a vertical (longitudinal) axis to perform the motion. Two Mechanical Muscles are attached to a user's Body Hook Gear 170. Specifically, the first Mechanical Muscle is attached to the right anterior trunk/torso harness hook TR3 and loaded in front of the user in the transverse (horizontal) plane anchored at the Core Cube using an adjustable anchor point. The second Mechanical Muscle is attached to the left posterior trunk/torso harness hook TR6 and is loaded from the back of the user in the transverse plane anchored at the Core Cube using an adjustable anchor point. By loading both the anterior and posterior hooks on the trunk/torso harness gear provides the user the direct line of force for correct muscular adaptation in the transverse plane. Notably, the load and resistance provided by each of the Mechanical Muscles are the same in magnitude, but are applied in opposite directions based upon the orientations of the Mechanical Muscles on the Core Cube in relation to the body gear unit/body gear hooks to which the Mechanical Muscles are attached. The constant non-variable load and consistent resistance allows the isometric, eccentric, and concentric muscle contractions for right trunk rotation to have greater gains in muscle recovery, muscle balance, muscle tone, muscle stability, and muscle control. The ability to micro-progress the non-variable load of the Mechanical Muscles decreases the internal and external stresses to the muscular system, thereby decreasing the risk of injury. Accordingly, in this configuration, the user would be initiating movement into right trunk rotation.

Right Trunk Lateral Flexion—

In FIG. 1, a user is loaded in the plane of motion which is the frontal or coronal plane from the top and the bottom to provide resistance for trunk lateral flexion. The user moves around a perpendicular axis to perform the motion. Two Mechanical Muscles are attached to a user's Body Gear Hooks. Specifically, the first Mechanical Muscle is attached to the right superior trunk/torso harness hook TR1 and loaded above the user in the frontal plane anchored at the Core Cube. The second Mechanical Muscle is attached to the left inferior trunk/torso harness hook TR8 and is loaded below the user in the frontal plane anchored at the a Core Cube. By loading both the superior and inferior hooks on the trunk/torso harness gear provides the user the direct line of force for correct muscular adaptation in the frontal plane (e.g., in a single plane). The constant non-variable load and consistent resistance allows the isometric, eccentric, and concentric muscle contractions for right trunk lateral flexion to have greater gains in muscle recovery, muscle balance, muscle tone, muscle stability, and muscle control. The ability to micro-progress the non-variable load of the Mechanical Muscles decreases the internal and external stresses to the muscular system, thereby decreasing the risk of injury. In this configuration, the user would be initiating movement into right trunk lateral flexion.

Combined Movement—

The biomechanics of trunk rotation can eventually combine tri-planar motion and infinite combinations within the tri-planar motion of the three cardinal planes. Illustrated in FIG. 1 are the motions of trunk rotation and lateral trunk flexion. In one embodiment, the user is attached to the Mechanical Muscles and the Core Cube according to both the arrangements described above (e.g., four Mechanical Muscles in total are attached as described for right trunk rotation and right trunk lateral flexion). In this configuration, the user first rotates to the right, then side-bends to the right. In other words, each of these motions is performed in a single combined motion/movement, and the exemplary Core Restore Training System apparatus is configured to support both motions in a single arrangement. In one embodiment, the user could first side-bend to the right, and then rotates his/her trunk to the right. In this configuration, the apparatus does not include loaded trunk flexion or loaded trunk extension. To add the tri-planar movement to FIG. 1, the added motion is in the sagittal plane. For example, one of the two motions uses trunk flexion. A user is loaded in the plane of motion that is sagittal plane from the back to provide resistance for trunk flexion. The user moves around or about a horizontal axis (e.g., an axis of movement) to perform the motion. Both Mechanical Muscles are attached to the posterior trunk/torso harness hooks at TR11 and TR12 and loaded in back of the user in the sagittal plane anchored at the Core Cube. This adds sagittal plane motion which could be a progressive step towards tri-planar motion. As such, it should be noted that the foregoing are provided by way of example only, and not limitation. Numerous other configurations involving a single plane of motion, two planes or three planes of motion may be provided via the exemplary apparatus.

For example, anterior pelvic tilt movement can be trained by attaching opposing Mechanical Muscles to the right posterior pelvic hook PH13 and left posterior pelvic hook PH14. Similarly, posterior pelvic tilt movement can be trained by attaching opposing mechanical muscles to right anterior pelvic hook PH3 and left anterior pelvic hook PH4. As another example, right cervical rotation can be trained using opposing Mechanical Muscles attached to anterior head hook HH3 loaded in front of the user in the transverse plane anchored at the Core Cube and posterior head hook HH4 loaded in back of the user in the transverse plane anchored at the Core Cube with the user moving his/her neck around a vertical axis for cervical rotation providing the user the direct line of forced needed correct muscular development. It should also be noted that although exemplary embodiments have been described that involve rotational movements of a user/body gear unit, other arrangements or exercises may involve movements of a user/body gear unit along an axis, where at least two Mechanical Muscles provide constant non-variable loads and consistent resistances that are equal and opposite in direction along the axis.

While various embodiments have been described above, it should be understood that they have been presented by way of example only, and not limitation. In particular, further embodiments are also described in the Provisional Application 61/579,457 and the APPENDIX to Provisional Application 61/579,457. Thus, the breadth and scope of the present disclosure should not be limited by any of the above-described exemplary embodiments, or any contained in the Provisional Application 61/579,457 and/or APPENDIX.

What is claimed is:

1. An apparatus, comprising:

a first retractor device, wherein the first retractor device comprises:

a first torsion spring having a first central axis;

a first cable that comprises an extendable and retractable first cord;

a first tapered drum that is attached to the first cable, wherein the first tapered drum comprises a conical shape, wherein the first cable is wound in a spiral around the first tapered drum, wherein the first retractor device provides a first constant non-variable load and a first constant resistance via the first cable in a first direction; and a first adjustment knob that is coaxial to the first central axis of the first torsion spring, wherein the first adjustment knob is for pre-tensioning the first torsion spring;

a second retractor device, wherein the second retractor device comprises:

a second torsion spring having a second central axis;

a second cable that comprises an extendable and retractable second cord;

a second tapered drum that is attached to the second cable, wherein the second tapered drum comprises a conical shape, wherein the second cable is wound in a spiral around the second tapered drum, wherein the second retractor device provides a second constant non-variable load and a second constant resistance via the second cable in a second direction that is opposite to the first direction, wherein the first constant non-variable load is the same as the second constant non-variable load, and wherein the first constant resistance is the same as the second constant resistance; and a second adjustment knob that is coaxial to the second central axis of the second torsion spring, wherein the second adjustment knob is for pre-tensioning the second torsion spring; and a body gear unit for engaging a human, comprising a plurality of hooks to attach the first retractor device and the second retractor device to provide the first constant non-variable load and the first constant resistance via the first cable in the first direction and the second constant non-variable load and the second constant resistance via the second cable in the second direction that is opposite to the first direction throughout a range of motion of a movement, wherein the movement includes an eccentric contraction and a corresponding concentric contraction in a single arrangement.

2. The apparatus of claim 1, further comprising:

an anchoring unit; and a plurality of anchor points for attaching each of the first retractor device and the second retractor device to the anchoring unit.

3. The apparatus of claim 2, wherein the anchoring unit comprises at least one moveable member for attaching the plurality of anchor points to the anchoring unit.

4. The apparatus of claim 2, wherein the plurality of anchor points are moveable about the anchoring unit to position each of the first retractor device and the second retractor device to provide desired directions of resistance.

5. The apparatus of claim 1, wherein each of the first retractor device and the second retractor device is adjustable via the first adjustment knob and the second adjustment knob, respectively, to provide a range of non-variable loads and a range of constant resistances.

6. The apparatus of claim 5, wherein the range of non-variable loads comprises: adjustable increments of less than or equal to one half pound, or adjustable increments of less than or equal to one pound.

7. The apparatus of claim 5, wherein the first retractor device and the second retractor device are tuned to provide a same resistance and a same constant non-variable load.

8. The apparatus of claim 1, wherein the first retractor device and the second retractor device are arranged to provide resistances to movement in a single plane of motion.

9. The apparatus of claim 1, further comprising:

a third retractor device; and a fourth retractor device.

10. The apparatus of claim 9, wherein the first retractor device and the second retractor device are arranged to provide resistances to movement in a first plane of motion and the third retractor device and the fourth retractor device are arranged to provide resistances to movement in a second plane of motion or in the first plane of motion.

11. The apparatus of claim 9, wherein the third retractor device and the fourth retractor device provide resistances in opposite directions.

12. The apparatus of claim 9, wherein the third retractor device and the fourth retractor device are attached to the body gear unit.

13. The apparatus of claim 1, wherein the first direction and the second direction are opposite directions along an axis of movement of the at least one body gear unit.

14. The apparatus of claim 1, wherein the first direction and the second direction are opposite directions about an axis of movement of the at least one body gear unit.

15. The apparatus of claim 1, wherein the movement includes both flexion movement and extension movement in the single arrangement.

16. A method, comprising:

attaching a body gear unit to a body;

attaching a first retractor device to a first hook of the body gear unit, wherein the first retractor device comprises a first torsion spring having a first central axis, a first tapered drum that is attached to a first cable, the first cable comprising an extendable and retractable first cord, wherein the first tapered drum comprises a conical shape, wherein the first cable is wound in a spiral around the first tapered drum, wherein the first retractor device provides a first constant non-variable load and a first constant resistance via the first cable in a first direction, and a first adjustment knob that is coaxial to the first central axis of the first torsion spring, wherein the first adjustment knob is for pre-tensioning the first torsion spring;

attaching a second retractor device to a second hook of the body gear unit, wherein the second retractor device comprises a second torsion spring having a second central axis, a second tapered drum that is attached to a second cable, the second cable comprising an extendable and retractable second cord, wherein the second tapered drum comprises a conical shape, wherein the second cable is wound in a spiral around the second tapered drum, wherein the second retractor device provides a second constant non-variable load and a second constant resistance via the second cable in a second direction that is opposite to the first direction, and a second adjustment knob that is coaxial to the second central axis of the second torsion spring, wherein the second adjustment knob is for pre-tensioning the second torsion spring, wherein the first constant non-variable load is the same as the second constant non-variable load, wherein the first constant resistance is the same as the second constant resistance, wherein the first retractor device is attached to the first hook of the body gear unit and the second retractor device is attached to the second hook of the body gear unit to provide the first constant non-variable load and the first constant resistance via the first cable in the first direction and the second constant non-variable load and the second constant resistance via the second cable in the second direction that is opposite to the first direction throughout a range of motion of a movement, wherein the movement includes an eccentric contraction and a corresponding concentric contraction in a single arrangement; and performing the movement using the body gear unit.

17. The method of claim 16, wherein the first direction and the second direction are opposite directions along an axis of movement of the at least one body gear unit.

18. The method of claim 16, wherein the first direction and the second direction are opposite directions about an axis of movement of the at least one body gear unit.

* * * * *